US010168083B2

(12) United States Patent
Wang et al.

(10) Patent No.: US 10,168,083 B2
(45) Date of Patent: Jan. 1, 2019

(54) REFRIGERATION SYSTEM AND HEAT EXCHANGER THEREOF

(71) Applicant: Hangzhou Sanhua Research Institute Co., Ltd., Hangzhou, Zhejiang (CN)

(72) Inventors: Yanhong Wang, Hangzhou (CN); Zhiyong Yao, Hangzhou (CN); Senlai Zhang, Hangzhou (CN)

(73) Assignee: Hangzhou Sanhua Research Institute Co., Ltd., Hangzhou, Zhejiang (CN)

( * ) Notice: Subject to any disclaimer, the term of this patent is extended or adjusted under 35 U.S.C. 154(b) by 482 days.

(21) Appl. No.: 14/753,127

(22) Filed: Jun. 29, 2015

(65) Prior Publication Data

US 2016/0010905 A1 Jan. 14, 2016

(30) Foreign Application Priority Data

Jul. 11, 2014 (CN) ..... 2014 1 0331506
Apr. 24, 2015 (CN) ..... 2015 1 0205213

(51) Int. Cl.
*F25B 39/02* (2006.01)
*F25B 39/04* (2006.01)
(Continued)

(52) U.S. Cl.
CPC ..... *F25B 39/028* (2013.01); *F25B 39/04* (2013.01); *F25B 41/067* (2013.01);
(Continued)

(58) Field of Classification Search
CPC ..... F25B 39/028; F25B 39/04; F25B 41/067; F25B 43/003; F28D 1/0443; F28D 1/0476;
(Continued)

(56) References Cited

U.S. PATENT DOCUMENTS 6,988,538 B2 * 1/2006 Merkys ..... F25B 39/04 165/122
7,963,097 B2 * 6/2011 Mastronarde ..... F28D 7/1623 60/39.511
(Continued)

FOREIGN PATENT DOCUMENTS

CN 1749680 A 3/2006
CN 201242319 Y 5/2009
(Continued)

OTHER PUBLICATIONS

Chinese 1st Office Action dated Aug. 22, 2018 in connection with Application No. 201510205213.2.

*Primary Examiner* — Filip Zec
(74) *Attorney, Agent, or Firm* — Wolf, Greenfield & Sacks, P.C.

(57) ABSTRACT

A refrigeration system and a heat exchanger are provided. The refrigeration system includes a compressor, a micro-channel condenser, a micro-channel evaporator and at least one throttling device which are connected by pipelines. Each of the micro-channel condenser and the micro-channel evaporator includes an inlet manifold and an outlet manifold, and a plurality of flat tubes being connected between the inlet manifold and the outlet manifold. The inlet manifold of the micro-channel evaporator is provided with a baffle, and the inlet manifold of the micro-channel evaporator is divided by the baffle into multiple manifold sections, and the manifold sections of the inlet manifold are isolated from each other by the baffle, and are each in communication with a certain number of the flat tubes, and are each not provided with a distribution pipe configured to distribute flow rate into the flat tubes in communication with the manifold sections.

18 Claims, 7 Drawing Sheets

(51) Int. Cl.

| | |
|---|---|
| ***F25B 41/06*** | (2006.01) |
| ***F25B 43/00*** | (2006.01) |
| ***F28F 9/02*** | (2006.01) |
| ***F28D 1/04*** | (2006.01) |
| ***F28D 1/047*** | (2006.01) |
| ***F28D 1/053*** | (2006.01) |
| *F28D 21/00* | (2006.01) |

(52) U.S. Cl.
CPC ..... *F25B 43/003* (2013.01); *F28D 1/0443* (2013.01); *F28D 1/0476* (2013.01); *F28D 1/05391* (2013.01); *F28F 9/0273* (2013.01); *F28D 2021/0061* (2013.01); *F28F 9/0275* (2013.01)

(58) Field of Classification Search
CPC ..... F28D 1/05391; F28D 2021/0061; F28F 9/0273; F28F 9/0275
See application file for complete search history.

(56) References Cited

U.S. PATENT DOCUMENTS

| | | | | |
|---|---|---|---|---|
| 2006/0054310 | A1* | 3/2006 | Kim | F25B 39/02 165/110 |
| 2006/0130517 | A1* | 6/2006 | Merkys | F25B 39/022 62/515 |
| 2008/0216493 | A1* | 9/2008 | Lin | H05K 7/20681 62/115 |
| 2011/0017438 | A1* | 1/2011 | Huazhao | F25B 39/028 165/174 |
| 2015/0101363 | A1 | 4/2015 | Matsuda et al. | |
| 2015/0129180 | A1* | 5/2015 | Strehlow | F25B 39/028 165/151 |

FOREIGN PATENT DOCUMENTS

| | | | |
|---|---|---|---|
| CN | 101639304 | A | 2/2010 |
| CN | 202792702 | U | 3/2013 |
| CN | 203274373 | U | 11/2013 |
| CN | 203629159 | U | 6/2014 |
| CN | 103913019 | A | 7/2014 |

* cited by examiner

REFRIGERATION SYSTEM AND HEAT EXCHANGER THEREOF

This application claims the benefit of priorities to Chinese Patent Application No. 201410331506.0 titled "REFRIGERATION SYSTEM AND HEAT EXCHANGER THEREOF, AND BAFFLE ARRANGING METHOD", filed with the Chinese State Intellectual Property Office on Jul. 11, 2014, and Chinese Patent Application No. 201510205213.2 titled "REFRIGERATION SYSTEM AND HEAT EXCHANGER THEREOF", filed with the Chinese State Intellectual Property Office on Apr. 24, 2015, the entire disclosures of both applications are incorporated herein by reference.

TECHNICAL FIELD

The present application relates to the field of refrigeration technique, and particularly relates to a refrigeration system and a heat exchanger thereof.

BACKGROUND

Currently, the cooper-tube-fin type (tube-fin type) heat exchanger occupies a leading role in the field of refrigeration technique since it has a simple machining technology and a low cost. The tube-fin type heat exchanger generally includes circular tubes and various types of fins, the tubes and fins are connected by a tube expander, thus the thermal contact resistance is large, and the heat exchanging coefficient is low, and the tubes are tend to move with respect to the fins, which may gradually enlarge holes in ribs, and further reduces the heat exchanging efficiency and shortens the service life. The micro-channel heat exchanger as a new-type, high-efficient and compact heat exchanger becomes a research hotspot at present and has already been applied in automotive air-conditioners and large commercial central air-conditioners.

FIG. 1 shows the structural principle of a conventional micro-channel refrigeration system. As shown in the Figure, the refrigeration system mainly includes a compressor 1', a condenser 2', a throttling device 3' and an evaporator 4'. The condenser 2' and the evaporator 4' each functions as a micro-channel heat exchanger and each mainly includes flat tubes, fins and manifolds. An ideal heat exchanging effect may be realized by using the micro-channel heat exchanger as the condenser, however when the micro-channel heat exchanger is used as the condenser, a non-uniform distribution of refrigerant may occur, which greatly decreases the heat exchanging performance of the heat exchanger. An existing solution to the above issue is described by taking the micro-channel evaporator 4' as an example, as shown in FIG. 2, the micro-channel evaporator 4' mainly includes two manifolds, including an inlet manifold 41' and an outlet manifold 42' which are configured to distribute and collect the refrigerant. Flat tubes 43' are regularly arranged between the two manifolds. Corrugated or louver-shaped fins 44' are provided between adjacent micro-channel flat tubes, to improve the heat exchanging efficiency between the heat exchanger and the air. For ensuring that the refrigerant in the micro-channel evaporator 4' can be uniformly distributed into each flat tube 43', a distribution pipe 5' with a sealed end is inserted into the manifold 41', and holes 51' or grooves are formed at intervals on a wall of the distribution pipe 5' in the length direction, thus via these holes 51' or grooves, the refrigerant can be uniformly distributed into each flat tube 43' for circulation.

In the case that the micro-channel heat exchanger is used as the evaporator, the distribution pipe for optimizing the distribution of the refrigerant needs to be provided at an inlet of the evaporator, and the quality of the distribution pipe directly affects the distribution of the refrigerant, thus the difficulty of manufacturing technique, and economic and time costs are bound to be increased. Especially for the household appliance industry, the time and economic costs for optimizing and manufacturing the distribution device occupy a very high proportion.

Besides, due to many influence factors, under different kinds of working conditions, each heat exchanger is required to perform the optimizing process of the distribution pipe, so as to effectively utilizing the heat exchanging area of the micro-channel heat exchanger, however the optimizing process may take a large amount of time, and also increases the difficulty of manufacturing technique.

SUMMARY

The present application is provided to avoid the problems of an increased difficulty of the manufacturing technique and the increased economic and time costs caused by providing a distribution pipe, and to improve the heat exchanging performances of a heat exchanger and an entire refrigeration system.

Technical solutions provided by the present application are as follows:

A refrigeration system includes a compressor, a micro-channel condenser, a micro-channel evaporator and at least one throttling device which are connected by pipelines, each of the micro-channel condenser and the micro-channel evaporator includes an inlet manifold and an outlet manifold, a plurality of flat tubes are connected between the inlet manifold and the outlet manifold of the micro-channel condenser and in communication with the inlet manifold and the outlet manifold of the micro-channel condenser, and a plurality of flat tubes are connected between the inlet manifold and the outlet manifold of the micro-channel evaporator and in communication with the inlet manifold and the outlet manifold of the micro-channel evaporator. The throttling device is arranged at the pipeline between the micro-channel condenser and the micro-channel evaporator, the inlet manifold of the micro-channel evaporator is provided with at least one baffle, the number of the baffle is n and n is greater than or equal to one, and the inlet manifold of the micro-channel evaporator is divided by the n baffle into at least two manifold sections arranged in order, the number of the manifold sections of the micro-channel evaporator is (n+1), and the adjacent manifold sections of the inlet manifold of the micro-channel evaporator are isolated from each other by the baffle; each of the manifold sections of the inlet manifold of the micro-channel evaporator is in communication with a certain number of the flat tubes and is provided with at least one connecting port configured to be in communication with the respective pipeline, and each of the manifold sections of the inlet manifold of the micro-channel evaporator is not provided with a distribution pipe configured to distribute flow rate into the flat tubes in communication with the manifold sections of the inlet manifold of the micro-channel evaporator.

A heat exchanger is further provided in the present application, which includes a first manifold and a second manifold, a plurality of flat tubes are connected between the first manifold and the second manifold and in communication with the first manifold and the second manifold. The first manifold is provided with at least one connecting port connected to an outside, and the second manifold is provided with at least two connecting ports connected to the outside, a baffle is provided and the number of the baffle is n, wherein n is greater than or equal to one, the second manifold is divided by the n baffle into (n+1) manifold sections arranged in order along a longitudinal direction of the second manifold, and the manifold sections are isolated from each other by the baffle; each of the manifold sections is in communication with a certain number of the flat tubes and is provided with at least one connecting port configured to be connected to a pipeline.

In the present application, the arrangement of the baffles beneficial to the refrigeration system may be selected according to condition of the wind velocity of the wind field of the air-side of each of the micro-channel condenser and the micro-channel evaporator, to enable the evaporator to have a high efficiency. For a conventional evaporator, a distribution pipe needs to be provided in an inlet manifold to optimize the distribution of the refrigerant, and the quality of the distribution pipe has a direct effect on the distribution of the refrigerant, thus the difficulty of manufacturing technique and the economic and time costs are bound to be increased. In the refrigeration system according to the present application, baffles are used to divide a manifold into multiple manifold sections, and each manifold section has a small length, and the number of flat tubes in communication with each manifold section is small, and the position of the baffles can be adjusted according to the nonuniform condition of the flow field of the air-side of the heat exchanger, to allow the refrigerant to be uniformly distributed in each manifold section, thereby enabling the refrigerant to be uniformly distributed in the whole evaporator, and improving the performance of the refrigeration system, enabling the system structure to be simple and economical, reducing the cost and facilitating implementation.

DETAILED DESCRIPTION

The present application is described in detail in conjunction with drawings and embodiments hereinafter.

In an embodiment of a refrigeration system (such as an air conditioning system) according to the present application, the distribution of refrigerant into a micro-channel evaporator is started from an outlet manifold of a micro-channel condenser, namely started when the refrigerant is still in single-phase liquid state, to well distribute the refrigerant in the evaporator, thereby improving the performance of the refrigeration system and reducing the cost.

Figure 1:
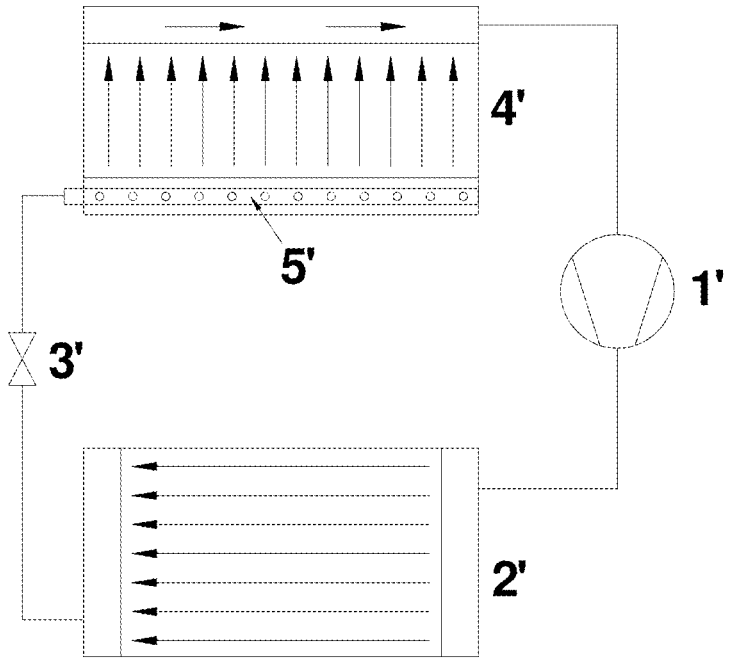
FIG. 1 is a principle schematic view showing the arrangement of a conventional refrigeration system.
Figure 2:
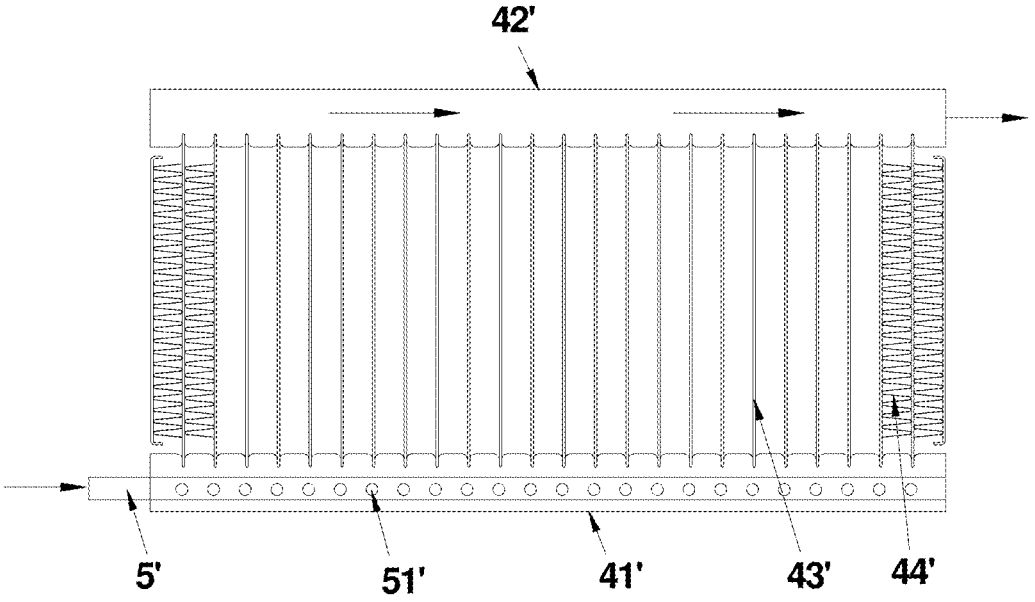
FIG. 2 is a schematic view showing the structure of a conventional micro-channel evaporator 4'.
Figure 3:
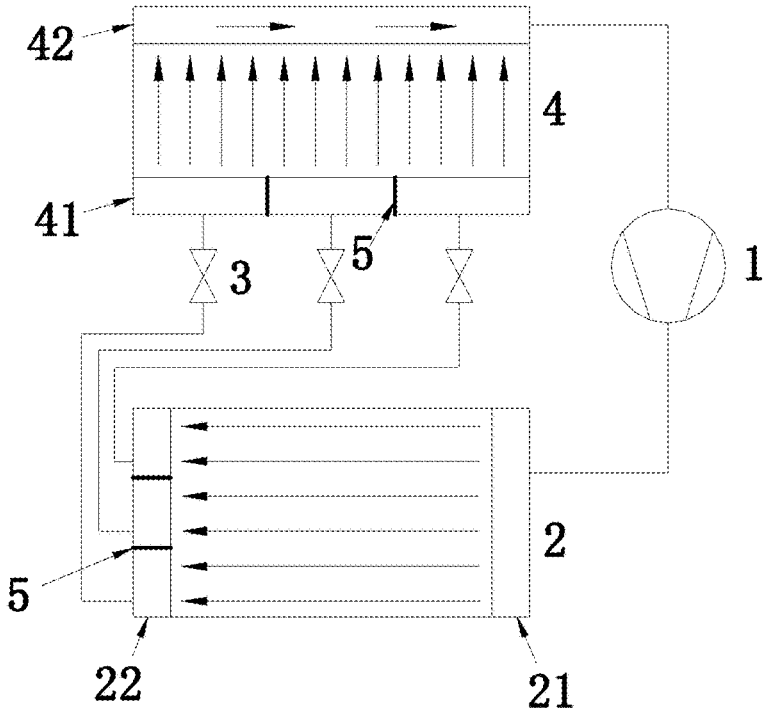
FIG. 3 is a schematic view showing the principle of an embodiment of a refrigeration system according to the present application.

FIG. 3 is a principle schematic view of this embodiment. As shown in FIGS. 3 to 6, the refrigeration system includes a compressor 1, a micro-channel condenser 2, a throttling device 3 and a micro-channel evaporator 4. Each of an outlet manifold 22 of the micro-channel condenser 2 and an inlet manifold 41 of the micro-channel evaporator 4 is provided with n baffles 5, wherein n is greater than or equal to 1. The outlet manifold 22 and the inlet manifold 41 are each divided into (n+1) manifold sections by the respective baffles 5. Multiple manifold sections of the outlet manifold 22 of the micro-channel condenser 2 and multiple manifold sections of the inlet manifold 41 of the micro-channel evaporator 4 are in a one-to-one correspondence and are in communication with each other via multiple branch pipelines. The throttling device 3 is disposed at each of the branch pipelines, and the throttling device 3 may be embodied as an expansion valve and/or a capillary.

For the micro-channel condenser 2, since the refrigerant at an inlet manifold 21 is in a single-phase gaseous state, the distribution ratio of the refrigerant is better, and the heat exchanging performance of the heat exchanger can be brought into full play. However the refrigerant at the inlet manifold 41 of the micro-channel evaporator 4 may be in a gas-liquid two-phase state or in a liquid state, thus the refrigerant may be unevenly distributed. The refrigerant in each section of the outlet manifold 22 of the micro-channel condenser 2 passes through a respective pipeline to be throttled by a drying and filtering unit 6, and then flows into a corresponding manifold section of the inlet manifold 41 of the micro-channel evaporator 4. Since the baffles 5 divide the inlet manifold 41 of the evaporator into multiple sections, each manifold section has a small length, and the number of flat tubes in communication with each manifold section is small, thus the refrigerant in each manifold section can be uniformly distributed, and the refrigerant can be uniformly distributed in the whole micro-channel evaporator.

The number of the baffles 5 in the outlet manifold 22 of the micro-channel condenser 2 is the same as the number (n) of the baffles 5 in the inlet manifold 41 of the micro-channel evaporator 4, the baffles 5 may be uniformly arranged, that is, each manifold section has the same length; or the arrangement of the baffles 5 may be adjusted according to nonuniform conditions of the flow field of the air-side of the heat exchanger, to divide the outlet manifold 22 into sections with different lengths. The baffles 5 in the inlet manifold 41 of the micro-channel evaporator 4 are generally uniformly arranged in the longitudinal direction, thus the refrigerant in each manifold section can be uniformly distributed into the flat tubes. In the case that the baffles 5 in the inlet manifold 41 of the micro-channel evaporator 4 are uniformly arranged, each manifold section has a substantially same length, and flat tubes corresponding to each manifold section have a substantially same number.

The baffles 5 are provided in the inlet manifold 41 of the micro-channel evaporator 4, thus the inlet manifold 41 of the micro-channel evaporator 4 is not required to be provided with a distribution pipe with distribution holes for distributing the refrigerant, and experimental verifications of the distribution holes are also not required to be performed to the refrigeration system, thereby simplifying the manufacture and facilitating implementing. And with such structure, the flow rate of the refrigerant flowing into each manifold section of the inlet manifold 41 of the micro-channel evaporator 4 can be adjusted to enable the flow rate of the refrigerate in each manifold section to correspond to the wind velocity of the flow field of the air-side of the micro-channel evaporator 4, thereby improving the efficiency of the system.

The number (n) of the baffles 5 in the inlet manifold 41 of the micro-channel evaporator 4 may be one, however in general case, the number (n) of the baffles 5 is greater than or equal to two, and especially for large-sized heat exchangers, the number (n) of the baffles 5 may be even greater than ten. In this embodiment, the number of the baffles in the outlet manifold 22 of the micro-channel condenser 2 is equal to the number of the baffles in the evaporator, and the manifold sections of the micro-channel evaporator 4 and the manifold sections of the micro-channel condenser 2 are connected in a one-to-one correspondence, and may even be connected in order. A drying and filtering unit 6 is disposed at each of the branch pipelines between the manifold sections of the micro-channel condenser 2 and the throttling devices 3, and the drying and filtering unit 6 includes a desiccant and an enclosed cavity configured to arrange the desiccant, and the cavity is in communication with a respective pipeline via an inlet and an outlet of the cavity. The baffles in the inlet manifold of the micro-channel evaporator may be substantially uniformly arranged, and accordingly, the baffles of the micro-channel condenser may also be substantially uniformly arranged, or a manifold section of the outlet manifold of the micro-channel condenser in communication with a manifold section at a middle portion of the micro-channel evaporator may be slightly longer, thus the refrigerant flowing into the middle portion of the micro-channel evaporator, which has a better heat exchanging performance, is more than the refrigerant flowing into other portions of the micro-channel evaporator. That is, a ratio of a length L1 of the manifold section of the micro-channel condenser in communication with the manifold section in the middle portion of the inlet manifold of the micro-channel evaporator by the branch pipeline, to the number n1 of the corresponding flat tubes in communication with the manifold section in the middle portion of the micro-channel evaporator is L1/n1. A ratio of a length L2 of a manifold section of the micro-channel condenser in communication with a manifold section deviating from the middle portion of the inlet manifold of the micro-channel evaporator, to the number n2 of the corresponding flat tubes in communication with the manifold section deviating from the middle portion of the inlet manifold of the micro-channel evaporator, is L2/n2, and the ratio of L1/n1 is greater than or equal to the ratio L2/n2.

In the case that the wind velocity of the flow field of the air-side of each of the micro-channel condenser and the micro-channel evaporator are uniform, the baffles 5 in the micro-channel condenser 2 may be uniformly arranged, and the baffles 5 in the micro-channel evaporator 4 may also be uniformly arranged.

In the case that the wind velocity of the wind field of the air-side of the micro-channel condenser is nonuniform while the wind velocity of the wind field of the air-side of the micro-channel evaporator is uniform, the position of the baffles 5 in the micro-channel condenser 2 may be appropriately adjusted according to the nonuniform condition of the wind velocity of the air-side of the micro-channel condenser, to enable the refrigerant flowing out of each manifold section of the outlet manifold 22 to have a substantially equal flow rate. For example, in a refrigeration system having two baffles, if the wind velocity of the air-side of the middle section of the micro-channel condenser is large, the two baffles 5 in the outlet manifold 22 should be arranged close to the middle of the outlet manifold 22, to allow the middle manifold section to have a short length and two manifold sections at two sides of the middle section to have a long length, thus the flow rates of the refrigerant in the three manifold sections are substantially the same, thereby allowing the flow rates of the refrigerant in all manifold sections of the micro-channel evaporator to be the same.

In the case that the wind velocity of the wind field of the air-side of the micro-channel condenser is uniform while the wind velocity of the wind field of the air-side of the micro-channel evaporator is nonuniform, in order to ensure the uniformity of the temperature of the micro-channel evaporator, the refrigerant in a manifold section of the micro-channel evaporator with a large average air-side wind velocity should have a large flow rate, therefore the baffles 5 in the micro-channel condenser should be accordingly adjusted to appropriately increase the length of the manifold section of the micro-channel condenser corresponding to the manifold section of the micro-channel evaporator with the large average air-side wind velocity, thereby ensuring that the refrigerant flowing into this manifold section of the micro-channel evaporator has a large flow rate. For example, in the case that the wind velocity of a middle portion of the micro-channel evaporator is large, the length L1 of the manifold section 221 of the micro-channel condenser in communication with the manifold section 413 at the middle portion of the micro-channel evaporator is relatively long.

In the case that the wind velocities of the air-sides of the micro-channel condenser and the micro-channel evaporator are both nonuniform, in order to ensure the effect of the micro-channel evaporator, the refrigerant of the manifold section of the micro-channel evaporator with a large air-side wind velocity should have a large flow rate, thus the baffles 5 in the micro-channel condenser should be adjusted according to the requirements for the flow rate of the refrigerant in each manifold section of the micro-channel evaporator, and the distribution of the wind velocity of the flow field of the air-side of the micro-channel condenser, to allow the flow rate of the refrigerant in each manifold section of the micro-channel condenser to ultimately meet the requirement.

With such arrangement, the baffles are used to divide each of the outlet manifold of the micro-channel condenser and the inlet manifold of the micro-channel evaporator into multiple parallel portions, the multiple parallel portions of the micro-channel condenser are arranged corresponding to the multiple parallel portions of the micro-channel evaporator, thus after the refrigerant passes through each portion of the micro-channel condenser, the refrigerant can flow into the respective portion of the micro-channel evaporator via a respective branch pipeline. Due to such arrangement, the refrigerant flowing into the micro-channel evaporator is located in separated areas, and the number of flat tubes in each separated area is not large, thus the refrigerant may uniformly flow into each flat tube, to realize the uniform distribution of the refrigerant. Due to this arrangement that the separated areas of the outlet manifold of the micro-channel condenser are in a one-to-one correspondence with the separated areas of the inlet manifold of the micro-channel evaporator, the positions of the baffles can be adjusted according to actual use condition, to meet the requirement of a uniform distribution of the evaporating temperature. Compared to the solution using the distribution pipe, the arrangement in the present application can be adjusted easily, and has a low cost and is easy to implement, thereby saving the cost and development time.

Figure 4:
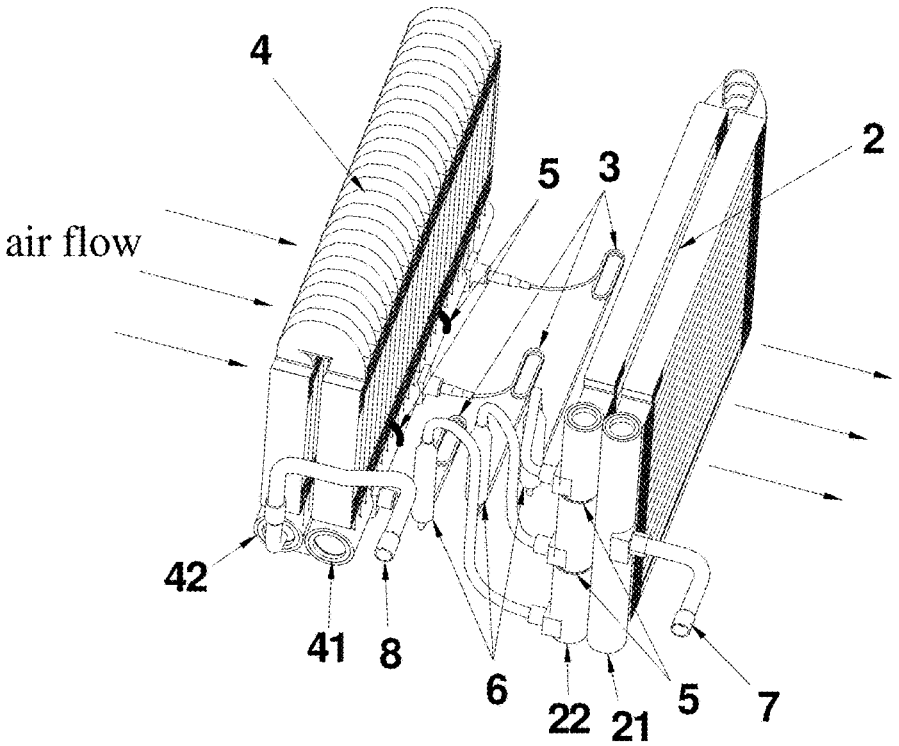
FIG. 4 is a schematic view showing a connection manner between a micro-channel condenser and a micro-channel evaporator in the refrigeration system.

FIG. 4 is a schematic view showing the structure of a specific application of the refrigeration system. Two baffles 5 are provided in the outlet manifold 22 of the micro-channel condenser 2, two baffles 5 are correspondingly provided in the inlet manifold 41 of the micro-channel evaporator 4, and the four baffles divide each of the outlet manifold 22 and the inlet manifold 41 into three sections. The three sections of the outlet manifold 22 of the micro-channel condenser 2 are correspondingly connected to the three sections of the inlet manifold 41 of the micro-channel evaporator 4 via respective pipelines, and a drying and filtering unit 6 and a capillary 3 (namely the throttling device) are provided in each pipeline. A connecting pipe 7 is provided, and has one end connected to the inlet manifold 21 of the micro-channel condenser 2 and another end connected to an outlet of the compressor. A connecting pipe 8 is provided, and has one end connected to an outlet manifold 42 of the micro-channel evaporator 4 and another end connected to an inlet of the compressor.

Figure 5:
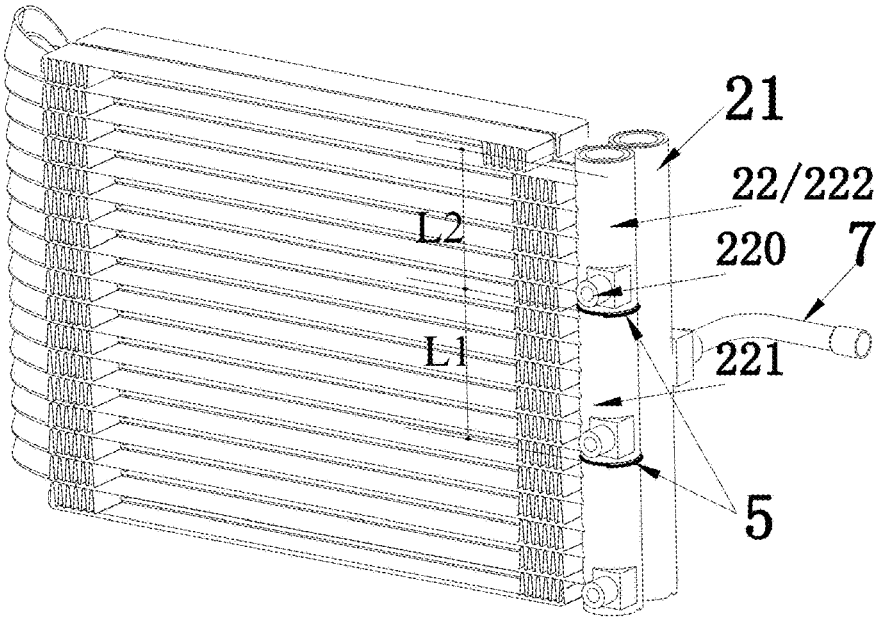
FIG. 5 is a perspective schematic view of the micro-channel condenser in FIG. 4.

FIG. 5 is a schematic view showing the structure of the micro-channel condenser 2. Two baffles 5 are provided in the outlet manifold 22 to divide the outlet manifold 22 of the micro-channel condenser 2 into three sections, a lower portion of each section is provided with a refrigerant outlet 220, and the refrigerant in the three sections of the outlet manifold 22 correspondingly flows into the three sections of the inlet manifold 41 of the micro-channel evaporator 4. The connecting pipe 7 has one end connected to the inlet manifold 21 of the condenser 2 and another end connected to an outlet of the compressor.

Figure 6:
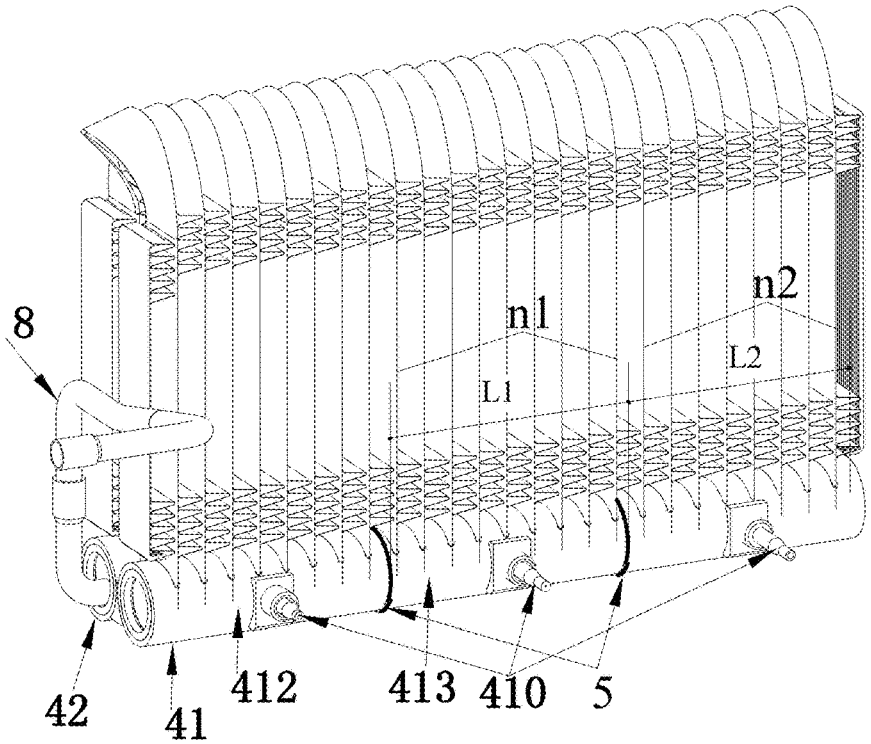
FIG. 6 is a perspective schematic view of the micro-channel evaporator in FIG. 4.

FIG. 6 is a schematic view showing the structure of the micro-channel evaporator 4. Two baffles 5 are provided in the inlet manifold 41 of the micro-channel evaporator 4 to divide the inlet manifold 41 into three sections, a lower portion of each section is provided with a refrigerant inlet 410, and the three sections of the inlet manifold 41 are corresponding to the three sections of the outlet manifold 22 of the micro-channel condenser 2. A manifold section 413 at the middle of the inlet manifold 41 is in communication with a manifold section 221 at the middle of the outlet manifold 22 of the micro-channel condenser 2, and a manifold section 412 at a side of the inlet manifold 41 is in communication with a manifold section 222 at a side of the outlet manifold 22 of the micro-channel condenser 2. The connecting pipe 8 has one end connected to the outlet manifold 42 of the evaporator 4 and another end connected to a suction inlet of the compressor.

The inlet manifold and the corresponding outlet manifold of the micro-channel condenser are generally upright arranged and are substantially in parallel with each other, multiple flat tubes are arranged between the inlet manifold and the outlet manifold and are in communication with the inlet manifold and the outlet manifold, and the flat tubes are transversely arranged and are in parallel with each other. The inlet manifold and the corresponding outlet manifold of the micro-channel condenser are both transversely arranged and are in parallel with each other, multiple flat tubes are arranged between the inlet manifold and the outlet manifold and are in communication with the inlet manifold and the outlet manifold, and the flat tubes are upright arranged and are in parallel with each other. The connecting port of each manifold section of the inlet manifold of the micro-channel evaporator is arranged at a substantially middle portion of the manifold section. As shown in the Figure, the inlet manifold and the outlet manifold of the micro-channel condenser are upright arranged and are in parallel with each other, and the flat tubes in parallel with each other between the two manifolds are horizontally arranged; the inlet manifold and the outlet manifold of the micro-channel evaporator are horizontally arranged and are in parallel with each other, and the flat tubes in parallel with each other between the two manifolds are vertically arranged. Due to such arrangement, the refrigerant can be uniformly distributed in the evaporator and the condenser, and the evaporator being arranged vertically may facilitate discharging the condensate water.

Figure 7:
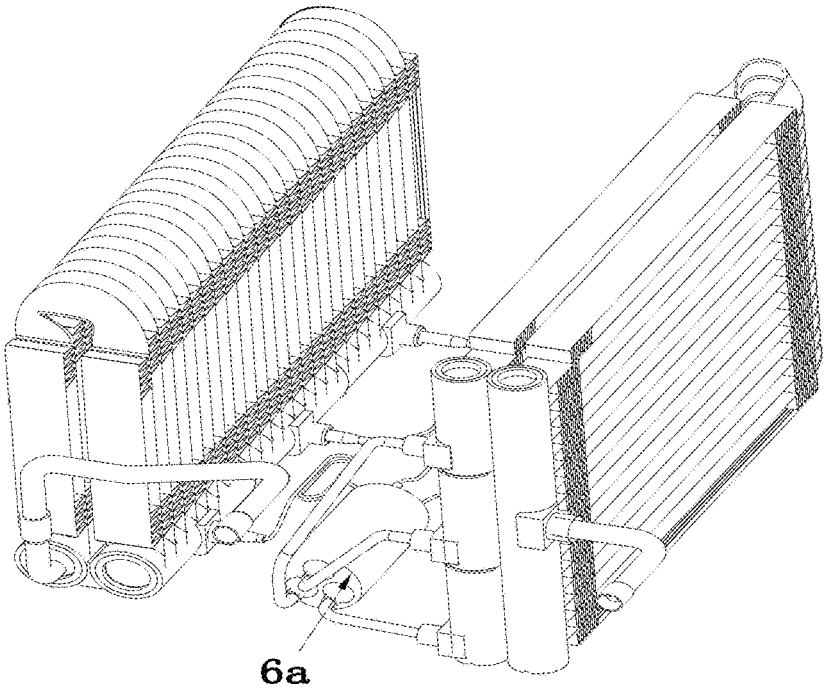
FIG. 7 is a schematic view showing another connection manner between the micro-channel condenser and the micro-channel evaporator in the refrigeration system.
Figure 8A:
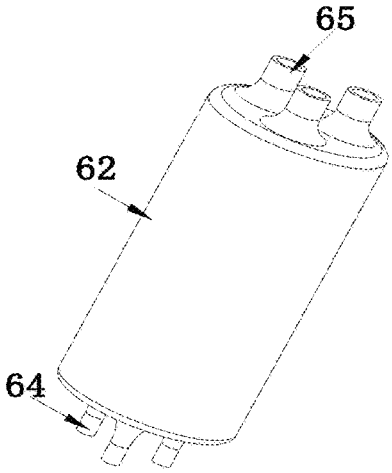
FIG. 8*a* is a perspective schematic view of a drying and filtering device 6 in FIG. 7.
Figure 8B:
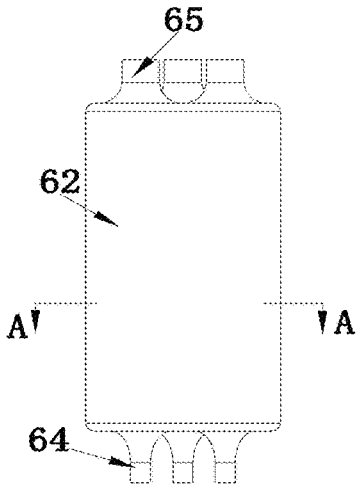
FIG. 8*b* is a front schematic view of the drying and filtering device 6 in FIG. 7.
Figure 8C:
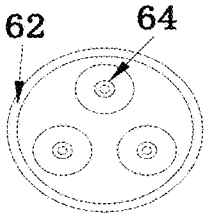
FIG. 8*c* is a bottom schematic view of the drying and filtering device 6 in FIG. 7.
Figure 8D:
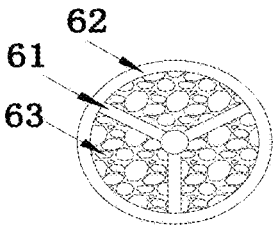
FIG. 8*d* is a sectional schematic view of the drying and filtering device 6 taken along the line A-A.

In this technical solution, the number of rows of each of the micro-channel condenser and the micro-channel evaporator may be greater than or equal to one, and the baffles may divide each manifold into two to ten sections or even more sections. Another technical solution is described hereinafter. As shown in FIG. 7, a drying and filtering device 6*a* is provided in this technical solution and includes multiple drying and filtering units which do not interfere with each other. The structure of the drying and filtering device 6*a* is shown in FIGS. 8*a* to 8*d*, the drying and filtering device 6*a* includes a substantially cylindrical housing 62, three partitions 61 are provided in the housing 62 to divide the drying and filtering device 6*a* into three sectors 63, and each of the sectors 63 is filled with a desiccant. The drying and filtering device 6*a* is provided with multiple inlets 65 and multiple outlets 64, and as shown in the figures, three inlets 65 and three outlets 64 are provided corresponding to the three sectors 63, thereby forming three drying and filtering passages which do not interfere with each other. That is, three separated drying and filtering units are combined together to form a combined drying and filtering unit. The shape of the housing 62 is not limited to cylindrical, and can also be rectangular or other shapes as long as it can be divided into multiple non-interfering drying cavities, and in this way, the structure of the drying and filtering device 6*a* is compact, the pipelines are simplified and the arranging spaces for components may be saved. The specific number of the partitions, namely the number of the sectors, is the same as the number of the manifold sections of the micro-channel evaporator. Generally, the number (n) of the baffles in the inlet manifold of the micro-channel evaporator is greater than or equal to two, and the number of the baffles of the micro-channel condenser is the same as the number (n) of the baffles in the inlet manifold of the micro-channel evaporator. A drying and filtering unit is arranged between the micro-channel condenser and the micro-channel evaporator, and the drying and filtering unit includes (n+1) outlets and (n+1) inlets, and also includes a divider. The divider is configured to divide the space of a cavity of the drying and filtering unit into (n+1) sectors independent from each other. Each of the sectors accordingly has one inlet and one outlet, the inlets of the sectors are in communication with the manifold sections of the inlet manifold of the micro-channel evaporator respectively via the branch pipelines, and the outlets of the sectors are in communication with the manifold sections of the outlet manifold of the micro-channel condenser respectively via the branch pipelines. The divider may be composed of multiple partitions, or may be an integrated divider. In the case that the wind velocity of the wind field of the air-side of the evaporator is not uniform, such as the wind velocity at a middle portion of the evaporator is large, in order to enable more refrigerant to flow into the middle portion of the evaporator, a manifold section of the condenser in communication with the manifold section at the middle portion of the evaporator may be adjusted, or a sectional area of the minimum circulating portion of the section corresponding to the outlet of the drying and filtering unit in communication with the manifold section at the middle portion of the evaporator may be adjusted. Besides, the throttling device may be arranged at an outlet end of the drying and filtering unit, an outlet end of the condenser, an inlet end of the evaporator, or the branch pipelines between the outlet end of the micro-channel condenser and the micro-channel evaporator. Other structure may refer to the above embodiments.

Figure 9:
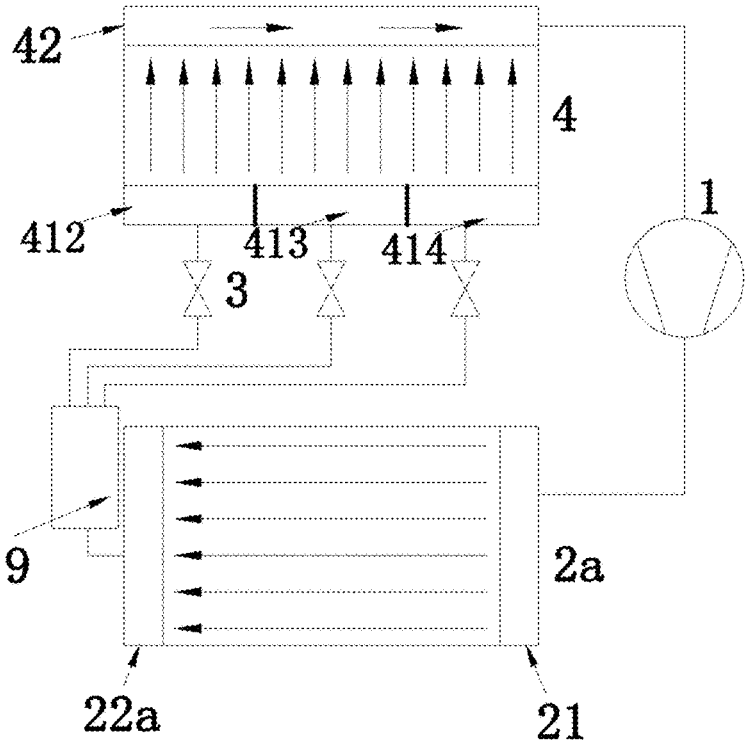
FIG. 9 is a schematic view showing the principle of another embodiment of the refrigeration system according to the present application.
Figure 10A:
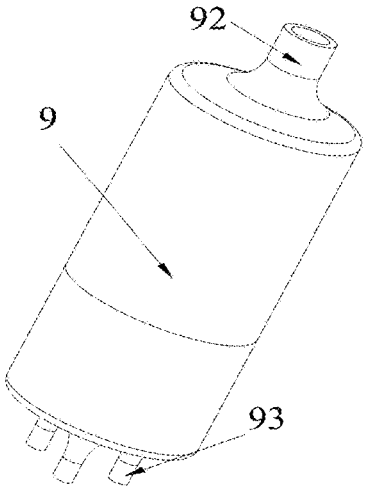
FIG. 10*a* is a perspective schematic view of a drying and filtering unit 9 in FIG. 9.
Figure 10B:
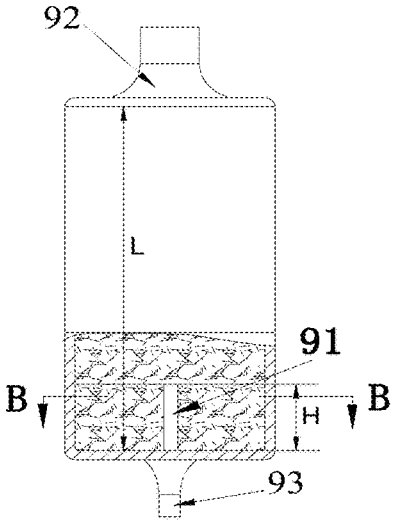
FIG. 10*b* is a partially sectional schematic view of the drying and filtering unit 9 in FIG. 9.
Figure 10C:
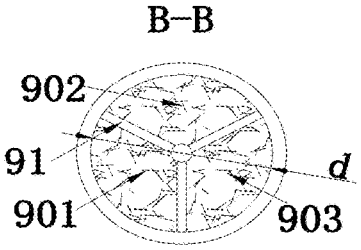
FIG. 10*c* is a sectional schematic view showing the drying and filtering unit 9 taken along the line B-B.

In addition, in order to reduce the connecting pipelines and facilitate manufacturing the micro-channel condenser, the drying and filtering unit may be further improved. The drying and filtering unit is provided with multiple outlets and one inlet. As shown in FIGS. 9 and 10, the number of outlets 93 of a drying and filtering unit 9 is the same as the number (n+1) of the manifold sections of the inlet manifold of the micro-channel evaporator 4. The drying and filtering unit 9 includes a divider 91, the divider 91 is configured to divide a space, close to the outlets, of the drying and filtering unit 9 into (n+1) independent sectors, or, the divider may separate most of the space close to the outlets into (n+1) independent sectors. Each of the sectors corresponds to one of the outlets 93, and the outlets 93 are in communication with the manifold sections in the inlet manifold of the evaporator via the branch pipelines respectively. In the case that the wind velocity of the wind field of the air-side of the evaporator is not uniform, for example the wind velocity of a middle portion of the evaporator is large, in order to enable more refrigerant to flow into the middle portion of the evaporator, a ratio of a sectional area of the minimum circulating portion of the sector corresponding to the outlet of the drying and filtering unit in communication with the manifold section at the middle portion of the inlet manifold of the evaporator, to the number (n1) of the flat tubes in communication with the manifold section at the middle portion of the inlet manifold of the evaporator, is set to be greater than or equal to a ratio of a sectional area of the minimum circulating portion of the sector corresponding to the outlet of the drying and filtering unit in communication with the manifold section deviating from the middle portion of the inlet manifold of the evaporator, to the number (n2) of the flat tubes in communication with the manifold section deviating from the middle portion of the inlet manifold of the evaporator. Thus the distribution of the refrigerant can be adjusted only by adjusting the divider of the drying and filtering unit according to the conditions of the wind field of the refrigeration system. An inlet 92 of the drying and filtering unit 9 is in communication with an outlet manifold 22*a* of a micro-channel condenser 2*a*. A throttling device may be provided in a pipeline between the drying and filtering unit 9 and an outlet end of the micro-channel condenser 2*a*, or pipelines between the multiple outlets 93 of the drying and filtering unit 9 and the micro-channel evaporator 4, and the throttling device is preferably arranged in front of the drying and filtering unit 9, in this way, the number of the throttling device can be obviously decreased. The divider herein may be used for distributing the refrigerant, for example, the size of each of the sectors divided by the divider may be adjusted according to the requirements of the evaporator, besides, flow distributing holes may be provided in the divider, the flow rate of the refrigerant in each section can be adjusted by changing the minimum circulating area of each sector of the drying and filtering unit, thus the flow rate of the refrigerant in each manifold section of the evaporator can be appropriately adjusted, thereby improving the efficiency of the refrigeration system.

Similarly, the drying and filtering unit may be upright arranged or obliquely arranged, the outlets of the drying and filtering unit which are configured to be connected to the evaporator are arranged at a lower portion of the drying and filtering unit while the inlet of the drying and filtering unit is arranged at an upper portion of the drying and filtering unit. The height h of the divider 91 of the drying and filtering unit 9 is less than the length L of the body of the drying and filtering unit. In the case that the drying and filtering unit is obliquely arranged, an included angle a formed between the drying and filtering unit in use and the horizontal plane satisfies the relationship of $\arctan(h/d) \leq a \leq 90$ degrees, wherein d refers to the hydraulic diameter of the interior of the drying and filtering unit.

Figure 11:
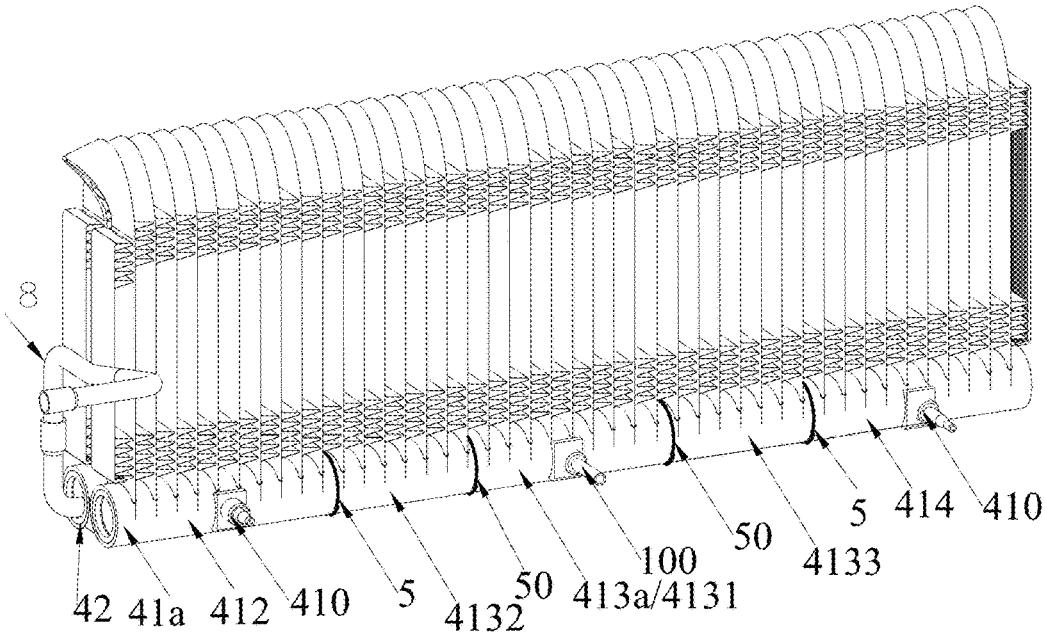
FIG. 11 is a perspective schematic view of another micro-channel evaporator.
Figure 12:
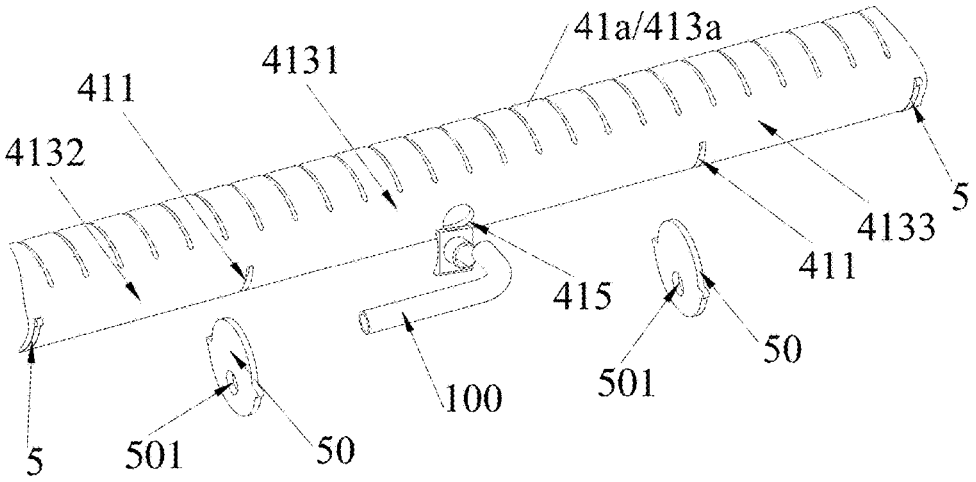
FIG. 12 is a partially exploded schematic view showing a middle manifold section of an inlet manifold of the micro-channel evaporator in FIG. 11.
Figure 13:
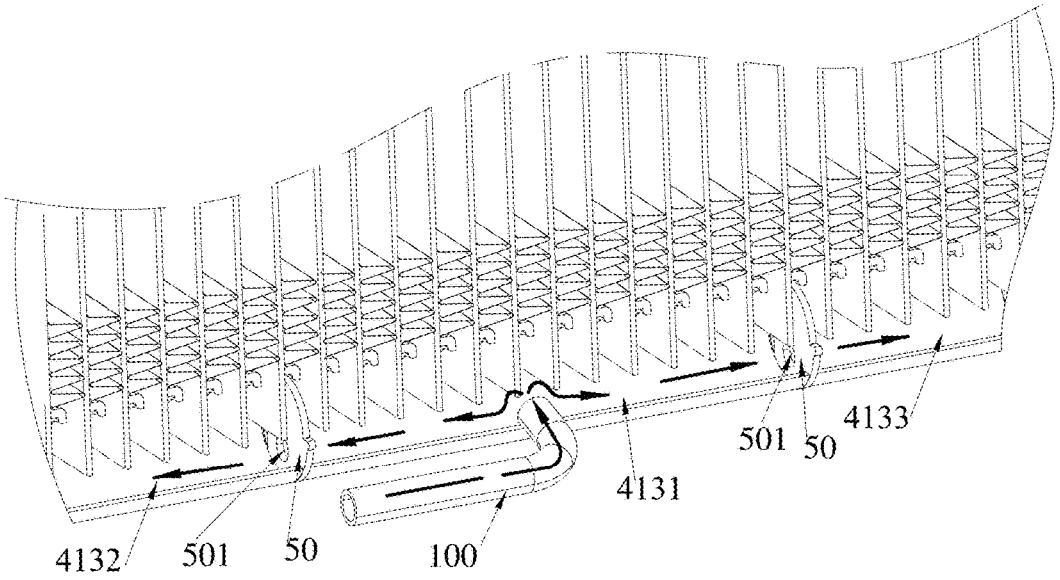
FIG. 13 is a schematic view showing a flowing path relevant to the middle manifold section of the inlet manifold of the micro-channel evaporator in FIG. 11.

In addition, for further satisfying the using requirement of a larger refrigeration system, a damper may be provided in the manifold section of the inlet manifold of the evaporator, to divide the manifold section into a first-level cavity in communication with an outside and an auxiliary cavity in communication with the first-level cavity via the damper. The auxiliary cavity may be a second-level cavity in communication with the first-level cavity via the damper, or the auxiliary cavity may also be a third-level cavity in communication with the first-level cavity via the second-level cavity. Referring to FIGS. 11 to 13, an inlet manifold 41 of the evaporator in this embodiment has multiple manifold sections, a manifold section 413*a* has a connecting port 415, and a damper 50 is provided at each of two sides of the connecting port 415, the two dampers 50 divide the manifold section 413*a* into a first-level cavity 4131 at a middle portion in communication with an outside via the connecting port 415, and two second-level cavities 4132, 4133 respectively arranged at two sides of the whole of two dampers or two sides of the first-level cavity. Each of the first-level cavity 4131 and the auxiliary cavities, i.e., the second-level cavities 4132, 4133, is in communication with a certain number of flat tubes 43. The first-level cavity 4131 is in communication with the outside via the connecting port 415 and a connecting pipe 100. The auxiliary cavities, i.e., the second-level cavities 4132, 4133, are in communication with the first-level cavity 4131 via the dampers 50 to further communicate with the outside. The damper 50 in this embodiment may be embodied as a damping plate with a circulating hole 501, and the second-level cavity may be in communication with the first-level cavity via the circulating hole 501 of the damping plate. In addition, multiple damping plates may be provided, accordingly the auxiliary cavity may be a multi-level cavity. Besides, the damper may be a perforated plate or a metal sponge and etc.

Moreover, the flow rate of the refrigerant of the evaporator in the above embodiments is distributed or adjusted by a condenser or a drying and filtering unit, and may also be adjusted by a throttling device. For example, in the case that the wind velocity of the wind field of the air-side of the evaporator is not uniform, the flow rate of the refrigerant may be distributed by adjusting the throttling device. In the case that the throttling device is embodied as an electronic expansion valve, the control and adjustment of the flow rate of the refrigerant may be realized by adjusting the size of a circulating valve port of the electronic expansion valve. In the case that the throttling device is embodied as a capillary, the control and adjustment of the flow rate of the refrigerant may be realized by changing the length of the capillary. Thus the control of the refrigeration system can be realized easily and conveniently. The refrigerant can be well distributed in the micro-channel evaporator without providing a distributing device, such as a distribution pipe, in the refrigeration system, and the structure of the refrigeration system is simple and economical, and is easy to implement.

The embodiments described hereinabove are only intended for describing the technical solutions of the present application, and should not be interpreted as limitation to the application scope of the present application. Any equivalent modifications and improvements made within the scope of the present application are also deemed to fall into the scope of the present application defined by the claims.

The invention claimed is:

1. A refrigeration system, comprising a compressor, a micro-channel condenser, a micro-channel evaporator and at least one throttling device which are connected by pipelines, each of the micro-channel condenser and the micro-channel evaporator comprising an inlet manifold and an outlet manifold, a first plurality of flat tubes being connected between the inlet manifold and the outlet manifold of the micro-channel condenser and in communication with the inlet manifold and the outlet manifold of the micro-channel condenser, and a second plurality of flat tubes being connected between the inlet manifold and the outlet manifold of the micro-channel evaporator and in communication with the inlet manifold and the outlet manifold of the micro-channel evaporator; and the throttling device is arranged at the pipeline between the micro-channel condenser and the micro-channel evaporator, the inlet manifold of the micro-channel evaporator is provided with at least one first baffle, the number of the at least one first baffle is n and n is greater than or equal to one, and the inlet manifold of the micro-channel evaporator is divided by the n baffle into at least two manifold sections arranged in order, the number of the manifold sections of the micro-channel evaporator is (n+1), and the adjacent manifold sections of the inlet manifold of the micro-channel evaporator are isolated from each other by the at least one first baffle; each of the manifold sections of the inlet manifold of the micro-channel evaporator is in communication with a specific number of the at least one first flat tubes and is provided with at least one connecting port configured to be in communication with the respective pipeline, and each of the manifold sections of the inlet manifold of the micro-channel evaporator is not provided with a distribution pipe configured to distribute flow rate into the flat tubes in communication with the manifold sections of the inlet manifold of the micro-channel evaporator, a ratio of a length L1 of the manifold section of the micro-channel condenser in communication with the manifold section in the middle portion of the inlet manifold of the micro-channel evaporator by the branch pipeline, to the number n1 of the flat tubes in communication with the manifold section in the middle portion of the micro-channel evaporator is L1/n1, a ratio of a length L2 of the manifold section of the micro-channel condenser in communication with the manifold section deviating from the middle portion of the inlet manifold of the micro-channel evaporator, to the number n2 of the flat tubes in communication with the manifold section deviating from the middle portion of the inlet manifold of the micro-channel evaporator, is L2/n2, and the ratio of L1/n1 is greater than or equal to the ratio L2/n2.

2. The refrigeration system according to claim 1, wherein the outlet manifold of the micro-channel condenser is provided with at least one second baffle, the number of the at least one second baffle of the outlet manifold of the micro-channel condenser is n, which is the same as the number of the baffle of the inlet manifold of the micro-channel evaporator, and the number of the throttling device is (n+1), which is the same as the number of the manifold sections of the inlet manifold of the micro-channel evaporator; each of the manifold sections of the inlet manifold of the micro-channel evaporator is in communication with one manifold section of the outlet manifold of the micro-channel condenser via a respective branch pipeline, and one of the throttling devices is disposed at each of the branch pipelines.

3. The refrigeration system according to claim 2, wherein the number of the baffle of the inlet manifold of the micro-channel evaporator is greater than or equal to two, a drying and filtering unit is disposed at each of the branch pipelines between the manifold sections of the outlet manifold of the micro-channel condenser and the throttling devices, the drying and filtering unit comprises a desiccant and an enclosed cavity configured to arrange the desiccant, and the cavity has an inlet and an outlet, and is in communication with the respective branch pipeline via the inlet and the outlet; the baffles in the inlet manifold of the micro-channel evaporator is approximately uniformly arranged.

4. The refrigeration system according to claim 1, wherein the number of the baffle of the inlet manifold of the micro-channel evaporator is greater than or equal to two, a drying and filtering unit is provided between the micro-channel condenser and the micro-channel evaporator, the drying and filtering unit comprises a plurality of outlets, and one inlet, the number of the outlets of the drying and filtering unit is the same as the number of the manifold sections of the inlet manifold of the micro-channel evaporator, and the drying and filtering unit comprises a divider; the divider is configured to divide a space of the drying and filtering unit close to the outlets into (n+1) independent sectors, each of the sectors corresponds to one of the outlets, and the outlets are in communication with the manifold sections of the inlet manifold of the micro-channel evaporator respectively via branch pipelines; a ratio of a sectional area of the minimum circulating portion of the sector corresponding to the outlet of the drying and filtering unit in communication with the manifold section at the middle portion of the inlet manifold of the micro-channel evaporator, to the number n1 of the flat tubes in communication with the manifold section at the middle portion of the inlet manifold of the micro-channel evaporator, is greater than or equal to a ratio of a sectional area of the minimum circulating portion of the sector corresponding to the outlet of the drying and filtering unit in communication with the manifold section deviating from the middle portion of the inlet manifold of the micro-channel evaporator, to the number n2 of the flat tubes in communication with the manifold section deviating from the middle portion of the inlet manifold of the micro-channel evaporator; the inlet of the drying and filtering unit is in communication with the outlet manifold of the micro-channel condenser; the throttling device is arranged in the pipeline between the drying and filtering unit and an outlet end of the micro-channel condenser, or pipelines between the outlets of the drying and filtering unit and the micro-channel evaporator.

5. The refrigeration system according to claim 1, wherein the number of the baffle of the inlet manifold of the micro-channel evaporator is greater than or equal to two, the outlet manifold of the micro-channel condenser is divided by a baffle into (n+1) manifold sections, a drying and filtering unit is provided between the micro-channel condenser and the micro-channel evaporator; the drying and filtering unit comprises a plurality of outlets and a plurality of inlets, the number of the inlets is the same as the number of the outlets, the number of the outlets of the drying and filtering unit is the same as the number of the manifold sections of the inlet manifold of the micro-channel evaporator, and the drying and filtering unit comprises a divider; the divider is configured to divide an inner space of the drying and filtering unit into (n+1) independent sectors, each of the sectors corresponds to one of the inlets and one of the outlets; the plurality of inlets of the drying and filtering unit are in communication with the manifold sections of the outlet manifold of the micro-channel condenser respectively; the throttling device is arranged at an outlet end of the drying and filtering unit, an outlet end of the micro-channel condenser, an inlet end of the micro-channel evaporator, or the branch pipelines between the outlet end of the micro-channel condenser and the micro-channel evaporator.

6. The refrigeration system according to claim 5, wherein the drying and filtering unit is upright arranged or obliquely arranged, and the outlets of the drying and filtering unit configured to be connected to the micro-channel evaporator are arranged at a lower portion of the drying and filtering unit, and the inlets of the drying and filtering unit are arranged at an upper portion of the drying and filtering unit.

7. The refrigeration system according to claim 6, wherein a height h of the divider of the drying and filtering unit is less than a length L of a body of the drying and filtering unit, and an included angle a formed between the drying and filtering unit in use and the horizontal plane satisfies the relationship of $\arctan(h/d) \leq a \leq 90$ degrees, wherein d refers to a hydraulic diameter of the interior of the drying and filtering unit.

8. The refrigeration system according to claim 6, wherein the inlet manifold and the corresponding outlet manifold of the micro-channel condenser are both upright arranged and are approximately in parallel with each other, a plurality of flat tubes between the inlet manifold and the outlet manifold of the micro-channel condenser and in communication with the inlet manifold and the outlet manifold of the micro-channel condenser are transversely arranged and are in parallel with each other; and the inlet manifold and the corresponding outlet manifold of the micro-channel evaporator are both transversely arranged and are in parallel with each other, a plurality of flat tubes between the inlet manifold and the outlet manifold of the micro-channel evaporator and in communication with the inlet manifold and the outlet manifold of the micro-channel evaporator are upright arranged and are in parallel with each other; the connecting port at each manifold section of the inlet manifold of the micro-channel evaporator is arranged at an approximately middle portion of the manifold section.

9. The refrigeration system according to claim 2, wherein the number of the baffle of the inlet manifold of the micro-channel evaporator is greater than or equal to two, the outlet manifold of the micro-channel condenser is divided by the baffle into (n+1) manifold sections, a drying and filtering unit is provided between the micro-channel condenser and the micro-channel evaporator; the drying and filtering unit comprises a plurality of outlets and a plurality of inlets, the number of the inlets is the same as the number of the outlets, the number of the outlets of the drying and filtering unit is the same as the number of the manifold sections of the inlet manifold of the micro-channel evaporator, and the drying and filtering unit comprises a divider; the divider is configured to divide an inner space of the drying and filtering unit into (n+1) independent sectors, each of the sectors corresponds to one of the inlets and one of the outlets; the plurality of inlets of the drying and filtering unit are in communication with the manifold sections of the outlet manifold of the micro-channel condenser respectively; the throttling device is arranged at an outlet end of the drying and filtering unit, an outlet end of the micro-channel condenser, an inlet end of the micro-channel evaporator, or the branch pipelines between the outlet end of the micro-channel condenser and the micro-channel evaporator.

10. The refrigeration system according to claim 9, wherein the drying and filtering unit is upright arranged or obliquely arranged, and the outlets of the drying and filtering unit configured to be connected to the micro-channel evaporator are arranged at a lower portion of the drying and filtering unit, and the inlets of the drying and filtering unit are arranged at an upper portion of the drying and filtering unit.

11. The refrigeration system according to claim 1, wherein at least one damper is disposed at two sides of the connecting port of at least one of the manifold sections of the inlet manifold of the micro-channel evaporator, the dampers are configured to divide this manifold section into a first-level cavity at a middle portion in communication with an outside via the connecting port, and auxiliary cavities arranged respectively at two sides of the first-level cavity, the first-level cavity and the auxiliary cavities are each in communication with a certain number of flat tubes, the first-level cavity is in communication with the outside via the connecting port, and the auxiliary cavities are in communication with the first-level cavity via the dampers to further communicate with the outside.

12. The refrigeration system according to claim 2, wherein at least one damper is disposed at two sides of the connecting port of at least one of the manifold sections of the inlet manifold of the micro-channel evaporator are each provided with, the dampers are configured to divide this manifold section into a first-level cavity at a middle portion in communication with an outside via the connecting port, and auxiliary cavities arranged respectively at two sides of the manifold section, the first-level cavity and the auxiliary cavities are each in communication with a certain number of flat tubes, the first-level cavity is in communication with the outside via the connecting port, and the auxiliary cavities are in communication with the first-level cavity via the dampers to further communicate with the outside.

13. The refrigeration system according to claim 4, wherein at least one damper is disposed at two sides of the connecting port of at least one of the manifold sections of the inlet manifold of the micro-channel evaporator, the dampers are configured to divide this manifold section into a first-level cavity at a middle portion in communication with an outside via the connecting port, and auxiliary cavities arranged respectively at two sides of the manifold section, the first-level cavity and the auxiliary cavities are each in communication with a certain number of flat tubes, the first-level cavity is in communication with the outside via the connecting port, and the auxiliary cavities are in communication with the first-level cavity via the dampers to further communicate with the outside.

14. The refrigeration system according to claim 5, wherein at least one damper is disposed at two sides of the connecting port of at least one of the manifold sections of the inlet manifold of the micro-channel evaporator are each provided with at least one damper, the dampers are configured to divide this manifold section into a first-level cavity at a middle portion in communication with an outside via the connecting port, and auxiliary cavities arranged respectively at two sides of the manifold section, the first-level cavity and the auxiliary cavities are each in communication with a certain number of flat tubes, the first-level cavity is in communication with the outside via the connecting port, and the auxiliary cavities are in communication with the first-level cavity via the dampers to further communicate with the outside.

15. The refrigeration system according to claim 1, wherein the inlet manifold and the corresponding outlet manifold of the micro-channel condenser are both upright arranged and are approximately in parallel with each other, a plurality of flat tubes between the inlet manifold and the outlet manifold of the micro-channel condenser and in communication with the inlet manifold and the outlet manifold of the micro-channel condenser are transversely arranged and are in parallel with each other; and the inlet manifold and the corresponding outlet manifold of the micro-channel evaporator are both transversely arranged and are in parallel with each other, a plurality of flat tubes between the inlet manifold and the outlet manifold of the micro-channel evaporator and in communication with the inlet manifold and the outlet manifold of the micro-channel evaporator are upright arranged and are in parallel with each other; the connecting port at each manifold section of the inlet manifold of the micro-channel evaporator is arranged at an approximately middle portion of the manifold section.

16. The refrigeration system according to claim 2, wherein the inlet manifold and the corresponding outlet manifold of the micro-channel condenser are both upright arranged and are approximately in parallel with each other, a plurality of flat tubes between the inlet manifold and the outlet manifold of the micro-channel condenser and in communication with the inlet manifold and the outlet manifold of the micro-channel condenser are transversely arranged and are in parallel with each other; and the inlet manifold and the corresponding outlet manifold of the micro-channel evaporator are both transversely arranged and are in parallel with each other, a plurality of flat tubes between the inlet manifold and the outlet manifold of the micro-channel evaporator and in communication with the inlet manifold and the outlet manifold of the micro-channel evaporator are upright arranged and are in parallel with each other; the connecting port at each manifold section of the inlet manifold of the micro-channel evaporator is arranged at an approximately middle portion of the manifold section.

17. The refrigeration system according to claim 4, wherein the inlet manifold and the corresponding outlet manifold of the micro-channel condenser are both upright arranged and are approximately in parallel with each other, a plurality of flat tubes between the inlet manifold and the outlet manifold of the micro-channel condenser and in communication with the inlet manifold and the outlet manifold of the micro-channel condenser are transversely arranged and are in parallel with each other; and the inlet manifold and the corresponding outlet manifold of the micro-channel evaporator are both transversely arranged and are in parallel with each other, a plurality of flat tubes between the inlet manifold and the outlet manifold of the micro-channel evaporator and in communication with the inlet manifold and the outlet manifold of the micro-channel evaporator are upright arranged and are in parallel with each other; the connecting port at each manifold section of the inlet manifold of the micro-channel evaporator is arranged at an approximately middle portion of the manifold section.

18. The refrigeration system according to claim 5, wherein the inlet manifold and the corresponding outlet manifold of the micro-channel condenser are both upright arranged and are approximately in parallel with each other, a plurality of flat tubes between the inlet manifold and the outlet manifold of the micro-channel condenser and in communication with the inlet manifold and the outlet manifold of the micro-channel condenser are transversely arranged and are in parallel with each other; and the inlet manifold and the corresponding outlet manifold of the micro-channel evaporator are both transversely arranged and are in parallel with each other, a plurality of flat tubes between the inlet manifold and the outlet manifold of the micro-channel evaporator and in communication with the inlet manifold and the outlet manifold of the micro-channel evaporator are upright arranged and are in parallel with each other; the connecting port at each manifold section of the inlet manifold of the micro-channel evaporator is arranged at an approximately middle portion of the manifold section.

* * * * *